US008305283B2

(12) United States Patent
Bourtoutian

(10) Patent No.: US 8,305,283 B2
(45) Date of Patent: Nov. 6, 2012

(54) COPLANAR DIFFERENTIAL BI-STRIP DELAY LINE, HIGHER-ORDER DIFFERENTIAL FILTER AND FILTERING ANTENNA FURNISHED WITH SUCH A LINE

(75) Inventor: Raffi Bourtoutian, Rueil-Malmaison (FR)

(73) Assignee: Commissariat à l'Energie Atomique, Paris (FR)

( * ) Notice: Subject to any disclaimer, the term of this patent is extended or adjusted under 35 U.S.C. 154(b) by 241 days.

(21) Appl. No.: 12/610,692

(22) Filed: Nov. 2, 2009

(65) Prior Publication Data

US 2010/0117759 A1 May 13, 2010

(30) Foreign Application Priority Data

Nov. 7, 2008 (FR) ..... 08 06220

(51) Int. Cl.
*H01Q 9/16* (2006.01)
*H01P 1/203* (2006.01)
*H01P 1/18* (2006.01)

(52) U.S. Cl. ..... 343/820; 333/161; 333/204
(58) Field of Classification Search ..... 333/161, 333/156, 204, 219; 343/795, 820
See application file for complete search history.

(56) References Cited

U.S. PATENT DOCUMENTS

| | | | | |
|---|---|---|---|---|
| 5,815,050 | A * | 9/1998 | Brooks et al. | 333/161 |
| 6,029,075 | A * | 2/2000 | Das | 505/210 |
| 2005/0128029 | A1 * | 6/2005 | Lee et al. | 333/161 |
| 2007/0040627 | A1 | 2/2007 | Kanno et al. | |
| 2007/0159271 | A1 * | 7/2007 | Kuylenstierna | 333/161 |

FOREIGN PATENT DOCUMENTS

| | | |
|---|---|---|
| FR | 2 240 536 | 3/1975 |
| JP | 2007-74274 | 3/2007 |
| WO | WO 98/00880 | 1/1998 |
| WO | WO 2006/088227 A1 | 8/2006 |

OTHER PUBLICATIONS

Wei-De Guo, et al., "Comparison between Flat Spiral and Serpentine Differential Delay Lines on TDR and TDT", IEEE, 2004, XP010780892, ISBN: 978-0-7803-8667-9, pp. 147-150.

* cited by examiner

*Primary Examiner* — Benny Lee
(74) *Attorney, Agent, or Firm* — Oblon, Spivak, McClelland, Maier & Neustadt, L.L.P.

(57) ABSTRACT

This coplanar differential bi-strip delay line includes two conducting strips disposed on one and the same face of a dielectric substrate and each comprising a first and a second end. The two first ends of the two conducting strips are respectively joined to two conductors of a first bi-strip port for connection to a first external differential device. The two second ends of the two conducting strips are respectively joined to two conductors of a second bi-strip port for connection to a second external differential device.

9 Claims, 8 Drawing Sheets

Fig.12
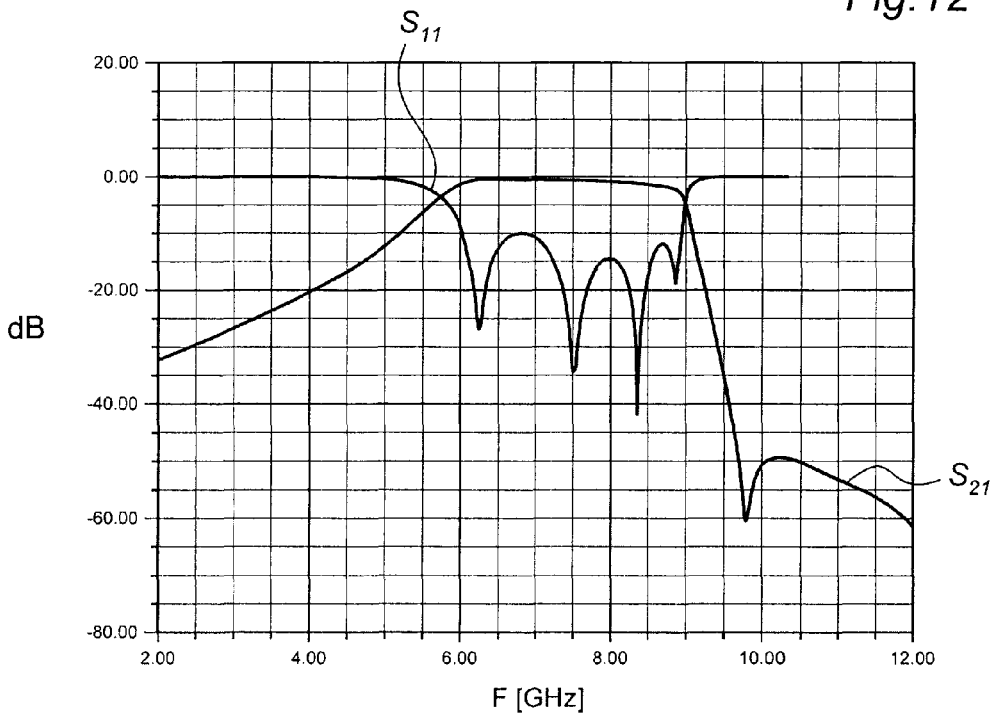
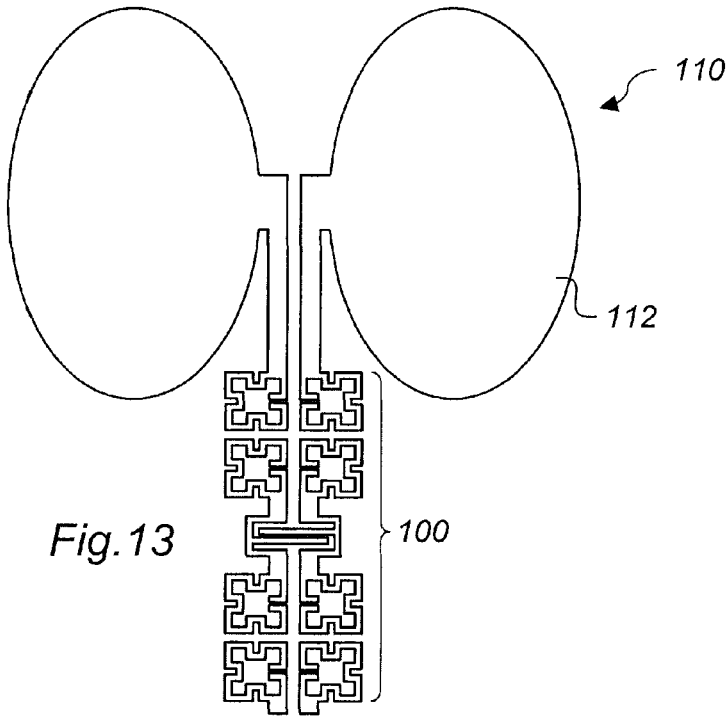
Fig.13

COPLANAR DIFFERENTIAL BI-STRIP DELAY LINE, HIGHER-ORDER DIFFERENTIAL FILTER AND FILTERING ANTENNA FURNISHED WITH SUCH A LINE

TECHNOLOGICAL FIELD

The present invention relates to a coplanar differential bi-strip delay line. It also relates to a higher-order differential filter and to a filtering antenna furnished with such a bi-strip delay line.

BACKGROUND

Radiofrequency transmission/reception systems fed with differential electrical signals are very attractive for current and future wireless communications systems, in particular for the concepts of autonomous communicating objects. A differential feed is a feed by two signals of equal amplitude in opposite phase. It helps to reduce, or indeed to eliminate, undesirable so-called "common mode" noise in transmission and reception systems.

In the realm of mobile telephony for example, when a non-differential system is used, a significant degradation of the radiation performance is indeed observed when the operator holds a handset furnished with such a system. This degradation is caused by the variation, due to the operator's hand, of the distribution of the current over the chassis of the handset used as ground plane. The use of a differential feed renders the system symmetric and thus reduces the concentration of current on the casing of the handset: it therefore renders the handset less sensitive to the common mode noise introduced by the operator's hand.

In the realm of antennas, a non-differential feed gives rise to the radiation of an undesirable cross-component due to the common mode flowing around the non-symmetric feed cables. The use of a differential feed eliminates the cross-radiation of the measurement cables and thus makes it possible to obtain reproducible measurements independent of the measurement context as well as perfectly symmetric radiation patterns.

In the realm of active hardware components, the power amplifiers of "push-pull" type, whose structure is differential, exhibit several advantages, such as the splitting of the power at output and the elimination of the higher-order harmonics. At reception, low noise differential amplifiers exhibit much promise in terms of noise factor reduction. Hence, the use of a differential structure prevents the undesirable triggering of the oscillators by the common mode noise.

A differential bi-strip delay line can be useful for joining two differential devices, such as for example, two filtering devices, so as to form a higher-order filter. In the particular case of the joining of two filtering devices, the differential bi-strip delay line must have the characteristics of a quarter-wave ($\pi/2$) phase shift line so as to be able to be used as impedance inverter.

More generally, a differential bi-strip delay line can be useful in a large number of applications making it necessary to join differential devices, including in the guise of phase shifter. For example, in a feed application for an antenna array, where several different antennas are fed by one or more sources, at least one phase shifter of this type can advantageously be envisaged.

Now, more and more differential devices, such as filtering devices or dipole antennas, are being designed with differential CPS ("CoPlanar Stripline") technology. Indeed, differential CPS technology makes it possible to profit from the advantages of differential structures while allowing simple coplanar integration with discrete elements: it is not necessary to create connections to link the elements together. Furthermore, the absence of any ground plane makes it possible to envisage a simple and less disturbing joining with, for example, a differential antenna.

It is therefore advantageous to also use this technology to produce a differential bi-strip delay line, in particular a quarter-wave line. According to this technique, a bi-strip line for propagating a differential signal comprises two rectilinear conducting strips disposed in parallel on one and the same face of a dielectric substrate and each comprising a first and a second end. The two first ends of the two conducting strips form two conductors of a first bi-strip port for connection to a first external differential device. The two second ends of the two conducting strips form two conductors of a second bi-strip port for connection to a second external differential device.

Thus, a differential bi-strip delay line designed in this way can be joined in an optimal manner to external devices designed with differential CPS technology. The delay that it induces and its impedance are directly related to its length, the separation between its two conducting strips and their width.

For example, the document "Broadband and compact coupled coplanar stripline filters with impedance steps", by Ning Yang et al, IEEE Transactions on Microwave Theory and Techniques, vol. 55, No. 12, December 2007, describes the realization of a filter with differential CPS technology, in particular with reference to FIG. 12 of "Broadband and compact coupled coplanar stripline filters with impedance steps". This compact topology makes it possible to attain high passbands with large out-of-band rejection for filters of order 2, 3 or 4. Unfortunately, the interposition of a differential CPS technology quarter-wave delay line between two filtering devices, such as that illustrated in the aforementioned document, although necessary to obtain a higher-order filter with good rejection properties, substantially increases the bulkiness of the complete device, mainly because of its length.

It may thus be desired to design, with differential CPS technology, a bi-strip delay line exhibiting better compactness while preserving the same performance in terms of phase shift and impedance matching as a bi-strip propagation delay line with predetermined phase shift.

SUMMARY OF THE INVENTION

The subject of the invention is therefore a coplanar differential bi-strip delay line, comprising two conducting strips disposed on one and the same face of a dielectric substrate and each comprising a first and a second end, the two first ends of the two conducting strips forming two conductors of a first bi-strip port for connection to a first external differential device, the two second ends of the two conducting strips forming two conductors of a second bi-strip port for connection to a second external differential device, this bi-strip line being furthermore devised in the form of a printed circuit so as to exhibit structural discontinuities which generate at least one impedance jump and at least one capacitive coupling with interdigitated capacitance between its two conducting strips so as to reproduce a predetermined phase shift, the interdigitated capacitance being formed by at least one pair of conducting fingers joined respectively by one of their ends to the two conducting strips.

The printed circuit of L, C type thus created exhibits, by virtue of its discontinuities (jump in impedance and capacitive coupling), an inductance L and a capacitance C, such that it can reproduce the phase shift characteristics of a conventional propagation delay line. Indeed, the phase shift $\phi$ of this circuit can be expressed as a function of L and C in the following manner: $\phi=2\pi\sqrt{LC}$. A phase shift is therefore created which, in the case of a propagation line, is normally dependent on its length.

In an optional manner, at least one of the structural discontinuities comprises a variation of the distance between the two conducting strips for producing an impedance jump.

In an optional manner also, a first discontinuity of increase in the distance between the two conducting strips and a second discontinuity of reduction in the distance between the two conducting strips form a zone of the substrate in which the bi-strip line exhibits a separation between its conducting strips, which is greater than the separation between the two conductors of each of its connection bi-strip ports.

In an optional manner also, the interdigitated capacitance is formed in the zone of the substrate in which the bi-strip line exhibits a larger separation between its conducting strips, the pair of conducting fingers extending laterally toward the interior of this zone from the two conducting strips.

In an optional manner also, the structural discontinuities generate at least one impedance jump and at least one capacitive coupling between its two conducting strips so as to reproduce a quarter-wave phase shift.

The subject of the invention is also a higher-order differential filter comprising two differential filtering devices with coplanar coupled resonators and a bi-strip line for transmitting a differential signal, such as previously defined, this bi-strip line being joined, via its first bi-strip port, to one of the two filtering devices and, via its second bi-strip port, to the other of the two filtering devices.

In an optional manner, each of the two differential filtering devices with coplanar coupled resonators comprises a pair of coupled resonators disposed on one and the same face of a dielectric substrate, each resonator comprising two conducting strips positioned in a symmetric manner with respect to a plane perpendicular to the face on which the resonator is disposed, these two conducting strips being joined respectively to two conductors of a differential bi-strip port of the corresponding differential filtering device, each conducting strip of each resonator being furthermore folded back on itself so as to form a capacitive coupling between its two ends.

Thus, the folding back of each conducting strip on itself makes it possible to envisage a lower filter size, for geometric reasons. Furthermore, the fact that this folding back is designed so as to form a capacitive coupling between the two ends of each conducting strip creates at least one additional frequency transmission zero ensuring high performance in terms of passband width and out-of-band rejection of the filtering device. Finally, the capacitive coupling by folding back also generates a magnetic coupling, the size of each conducting strip can be further reduced while ensuring one and the same filtering function of the assembly.

Finally, the subject of the invention is also a differential filtering dipole antenna comprising at least one higher-order differential filter such as previously defined.

In an optional manner, a differential filtering dipole antenna according to the invention can comprise a radiating structure devised so as to integrate in its exterior dimensions said higher-order differential filter.

BRIEF DESCRIPTION OF THE DRAWINGS

The invention will be better understood with the aid of the description which follows, given solely by way of example while referring to the appended drawings in which:

FIG. 12 illustrates the characteristic of a frequency response in terms of transmission and reflection of the filter of FIG. 11, FIGS. 13, 14 and 15 schematically represent three embodiments of filtering antennas according to the invention.

DETAILED DESCRIPTION OF THE PREFERRED EMBODIMENTS

Figure 1:
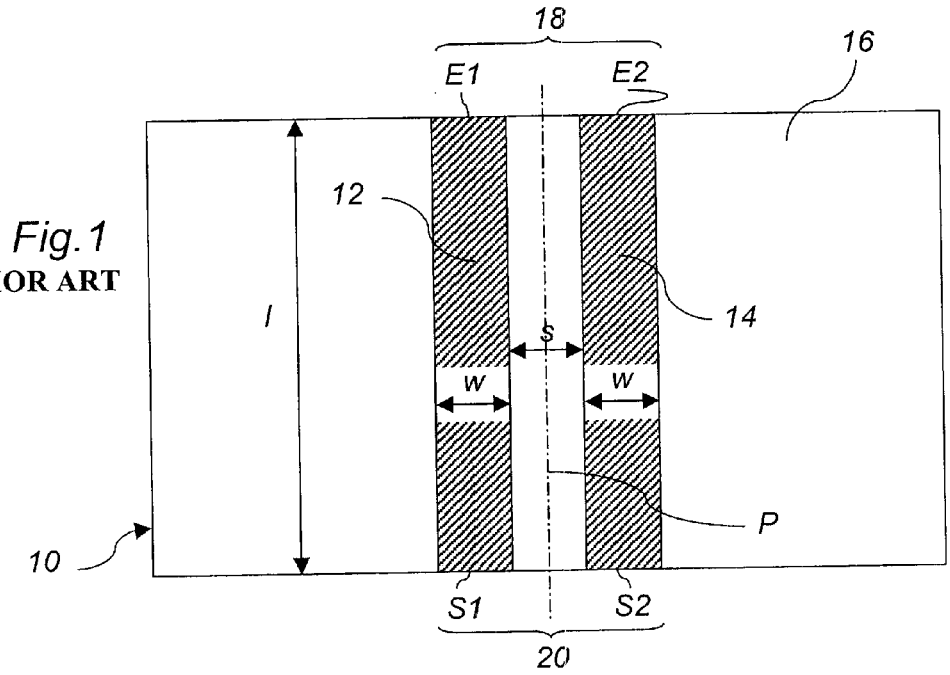
Fig.1 PRIOR ART
FIG. 1 schematically represents the general structure of a differential bi-strip line of the prior art in CPS technology.

The coplanar differential bi-strip delay line 10 represented in FIG. 1 comprises two conducting strips 12 and 14 disposed on one and the same plane face 16 of a dielectric substrate.

The conducting strip 12 comprises a first end E1 and a second end S1. Likewise, the second conducting strip 14 comprises a first end E2 and a second end S2.

The two first ends E1 and E2 of the two conducting strips 12 and 14 form respectively two conductors of a first bi-strip port 18 for connection to a first external differential device (not represented) and the two second ends S1 and S2 of the two conducting strips form respectively two conductors of a second bi-strip port 20 for connection to a second external differential device (not represented).

The two conducting strips 12 and 14 are rectilinear. They are also parallel and symmetric with respect to a plane P perpendicular to the plane face 16 and forming a virtual electrical ground plane of the differential bi-strip line. They are of a width w and a distance s apart, these two parameters w and s defining the impedance characteristic of the bi-strip line 10.

They are furthermore of a length l, this length l defining the phase shift generated by the bi-strip line on a differential signal that the bi-strip line propagates and therefore the bi-strip line's impedance matching. This is why, for a predetermined phase shift, for example a quarter-wave phase shift, a certain length of this bi-strip propagation line is necessary, thereby generating additional bulkiness of the device into which the bi-strip line 10 is integrated.

Figure 2:
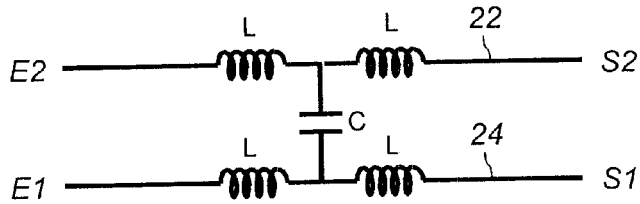
Fig.2 PRIOR ART
FIG. 2 represents an equivalent electrical circuit of the bi-strip line of FIG. 1, FIG. 3 schematically represents the general structure of a differential bi-strip delay line according to an embodiment of the invention, FIG. 4 schematically represents the general structure of a first exemplary filtering device for producing a higher-order filter according to the invention.

An equivalent electrical circuit of this bi-strip line 10 is represented in FIG. 2. This electrical circuit comprises two conducting wires 22 and 24 between which a capacitor C is disposed in parallel. Each conducting wire portion 22 or 24, between one of the terminals of the capacitor C and one of the ends E1, E2, S1 and S2 of the circuit, furthermore comprises an inductor L. This electrical circuit model produces a bi-strip delay line of predetermined phase shift obtained through given values of the capacitance C and of the inductances L.

Figure 3:
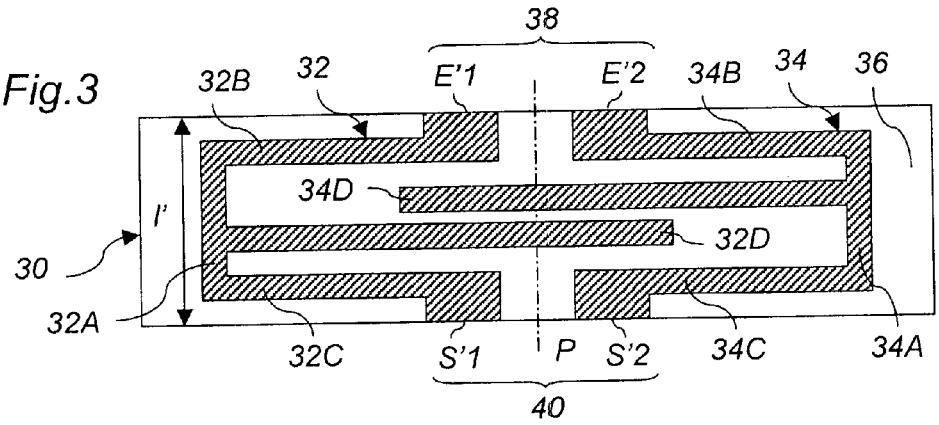

The same electrical circuit with discrete elements L and C can be produced with the aid of a bi-strip line 30 such as that represented in FIG. 3, in accordance with an embodiment of the invention. This bi-strip line 30 can therefore be modeled by the same electrical circuit as the bi-strip line 10.

Like the bi-strip line 10, it comprises two conducting strips 32 and 34 disposed on one and the same plane face 36 of a dielectric substrate. But unlike the bi-strip line 10 of FIG. 1, the two conducting strips 32 and 34 are devised in the form of a printed circuit exhibiting structural discontinuities.

The conducting strip 32 comprises a first end E'1 and a second end S'1. Likewise, the second conducting strip 34 comprises a first end E'2 and a second end S'2.

The two first ends E'1 and E'2 of the two conducting strips 32 and 34 form respectively two conductors of a first bi-strip port 38 for connection to a first external differential device (not represented) and the two second ends S'1 and S'2 of the two conducting strips form respectively two conductors of a second bi-strip port 40 for connection to a second external differential device (not represented).

The capacitive coupling and the impedance jumps of the bi-strip line 30, imparting a predetermined phase shift thereto, are generated directly by structural discontinuities which themselves generate an inductance and a capacitance. More precisely, these structural discontinuities comprise, on the one hand, breaks in linearity of the conducting strips 32 and 34 and, on the other hand, formations of additional conducting branches extending from the conducting strips 32 and 34.

The breaks in linearity make it possible to vary the distance between the two conducting strips for producing at least one impedance jump.

Thus, the first conducting strip 32 exhibits several breaks in linearity allowing a portion 32A of this conducting strip 32 to be further away from the symmetry plane P than the portions E1 and S'1 forming the ends of this conducting strip 32, while maintaining the portions E'1, S'1 and 32A parallel to the symmetry plane P. These breaks in linearity are produced by a portion 32B of the conducting strip 32, extending laterally and orthogonally to the plane P from an end of the portion E'1 toward an end of the portion 32A, and by a portion 32C of the conducting strip 32, extending laterally and orthogonally to the plane P from the other end of the portion 32A toward an end of the portion S'1.

By symmetry, the second conducting strip 34 exhibits several breaks in linearity allowing a portion 34A of this conducting strip 34 to be further away from the symmetry plane P than the portions E'2 and S'2 forming the ends of this conducting strip 34, while maintaining the portions E'2, S'2 and 34A parallel to the symmetry plane P. These breaks in linearity are produced by a portion 34B of the conducting strip 34, extending laterally and orthogonally to the plane P from an end of the portion E'2 toward an end of the portion 34A, and by a portion 34C of the conducting strip 34, extending laterally and orthogonally to the plane P from the other end of the portion 34A toward an end of the portion S'2.

Consequently, the bi-strip line 30 exhibits a first structural discontinuity, of increase in the distance between its two conducting strips 32 and 34, produced by the portions 32B and 34B, for producing a first impedance jump. Indeed, impedance increases with the distance between the two conducting strips.

It also exhibits a second structural discontinuity, of reduction in the distance between its two conducting strips 32 and 34, produced by the portions 32C and 34C, for producing a second impedance jump by reducing this impedance.

These two structural discontinuities create a rectangular zone, essentially delimited by the portions 32B, 32A, 32C, 34C, 34A and 34B, in which the bi-strip line 30 exhibits a separation between its conducting strips 32 and 34 that is greater than the separation between the two conductors E'1, E'2 and S'1, S'2 of each of its connection bi-strip ports 38 and 40 respectively.

The formations of additional conducting branches extending from the conducting strips 32 and 34 make it possible to create at least one interdigitated capacitance for producing the capacitive coupling between the two conducting strips 32 and 34.

More precisely, in the example of FIG. 3, an interdigitated capacitance is formed by two conducting fingers 32D and 34D extending in parallel one with respect to the other and orthogonally to the plane P, facing one another over at least a part of their length. The conducting finger 32D consists of a rectilinear conducting strip portion one end of which is secured to the portion 32A of the first conducting strip 32 and the other end of which remains free, while the conducting finger 34D consists of a rectilinear conducting strip portion one end of which is secured to the portion 34A of the second conducting strip 34 and the other end of which remains free.

The pair of conducting fingers therefore extends laterally toward the interior of the rectangular zone defined previously from the portions 32A and 34A of the two conducting strips 32 and 34, thereby making use of the zone of the substrate in which the bi-strip line 30 exhibits a larger separation between its conducting strips 32 and 34 to form the interdigitated capacitance.

As a variant, it is possible to create several parallel interdigitated capacitances in the previously defined rectangular zone. This makes it possible to increase the capacitance of the printed circuit formed by the bi-strip line 30 without changing its inductance. Stated otherwise, this involves an additional parameter for adjusting the impedance characteristic of the bi-strip line 30 with given phase shift. It will be noted however that the addition of interdigitated capacitances increases the length and therefore the bulkiness of the bi-strip line, this not always being desirable.

In a concrete manner, it is simple for the person skilled in the art to adjust the dimensions of the various aforementioned elements of the bi-strip line 30, so as to obtain a delay line of predetermined phase shift by adjusting, in particular, its capacitive coupling and its impedance jumps.

The length l' of the bi-strip line 30 thus produced is markedly less than the length l of a bi-strip line 10 of FIG. 1 of the prior art with identical equivalent electrical circuit, by virtue of the structural discontinuities. It follows from this that a bi-strip line according to the invention exhibits greater compactness while preserving the same characteristics as a bi-strip line of the prior art.

In practice, it is in particular possible to design a quarter-wave line according to the invention so as to link, with better compactness, two differential filtering devices with coplanar coupled resonators and thus produce a higher-order filter using CPS technology.

A higher-order differential filter according to the invention therefore comprises at least two differential filtering devices with coplanar coupled resonators and at least one differential bi-strip line shown in the embodiment of FIG. 3, this bi-strip line of the embodiment of FIG. 3 being joined, via its first bi-strip port 38, to one of the two filtering devices and, via its second bi-strip port 40, to the other of the two filtering devices.

Each of the two filtering devices can for example be designed in accordance with the example illustrated by FIG. 12 of the document "Broadband and compact coupled coplanar stripline filters with impedance steps", by Ning Yang et al, IEEE Transactions on Microwave Theory and Techniques, vol. 55, No. 12, December 2007.

However, the compactness of the filtering devices to which the differential bi-strip line is joined could also be advantageously improved. Combined with the improved compactness of the bi-strip line according to the invention, it would then make it possible to envisage a yet more compact higher-order filter.

Several examples of differential filtering devices with coupled resonators having improved compactness, particularly suited to the realization of higher-order filters including at least one bi-strip line according to the invention, will now be described in a detailed manner and with reference to FIGS. 4 to 8.

Figure 4:
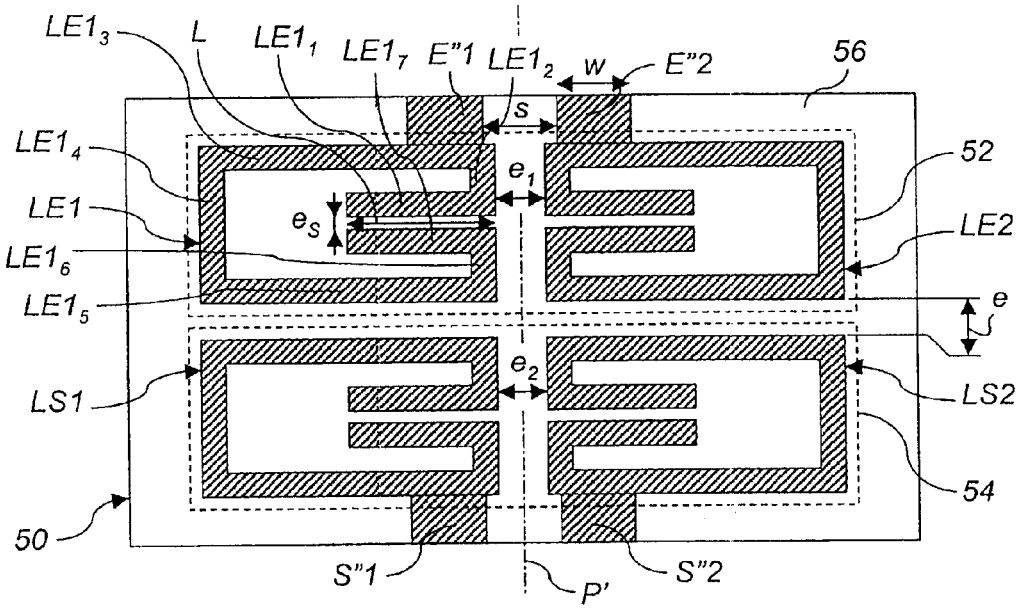

The coupled-resonator differential filtering device 50 represented in FIG. 4 comprises at least one pair of resonators 52 and 54, coupled together by capacitive coupling and disposed on one and the same plane face 56 of a dielectric substrate.

The first resonator 52, consisting of a bi-strip line portion, is linked to two conductors E"1 and E"2 of a bi-strip port for connection to a line for transmitting a differential signal. These two conductors E"1 and E"2 of the bi-strip port are symmetric with respect to a plane P' perpendicular to the plane face 56 and forming a virtual electrical ground plane. They are of a width w and a distance s apart, these two parameters s and w defining the impedance of the bi-strip port.

Similarly, the second resonator 54, likewise consisting of a bi-strip line portion, is linked to two conductors S"1 and S"2 of a bi-strip port for connection to a line for transmitting a differential signal. These two conductors S"1 and S"2 of the bi-strip port are also symmetric with respect to the virtual electrical ground plane P'.

The two resonators 52 and 54 are themselves symmetric with respect to an axis normal to the plane P' situated on the plane face 56. Consequently, the filtering device 50 is symmetric between its differential input and its differential output so that the differential input and differential output can be inverted completely. Thus, in the subsequent description of the embodiment represented in FIG. 4, the two conductors E"1 and E"2 will be chosen by convention as being the input bi-strip port of the filtering device 50, for the reception of an unfiltered differential signal. The two conductors S"1 and S"2 will be chosen by convention as being the output bi-strip port of the filtering device 50, for the provision of the filtered differential signal.

More precisely, the first resonator 52 comprises two conducting strips identified by their references LE1 and LE2. These two conducting strips LE1 and LE2 are positioned in a symmetric manner with respect to the virtual electrical ground plane P'. They are respectively linked to the two conductors E"1 and E"2 of the input port. The second resonator 54 comprises two conducting strips identified by their references LS1 and LS2. These two conducting strips LS1 and LS2 are also positioned in a symmetric manner with respect to the virtual electrical ground plane P'. They are respectively linked to the two conductors S"1 and S"2 of the output port.

The capacitive coupling of the two resonators 52 and 54 is ensured by the opposite but contactless disposition of their respective pairs of conducting strips. Thus, the conducting strips LE1 and LS1, situated on one and the same side with respect to the virtual electrical ground plane P', are disposed opposite one another a distance e apart. Likewise, the conducting strips LE2 and LS2, situated on the other side with respect to the virtual electrical ground plane P', are disposed opposite one another the same distance e apart.

This distance e between the two resonators 52 and 54 influences mainly the passband of the filtering device 50 and has a secondary effect on its characteristic impedance. The more e decreases, that is to say the higher the capacitive coupling between the two resonators, the wider the passband. The effect of this is also to increase the impedance. More precisely, the passband is broadened by the appearance of two distinct reflection zeros inside this passband, corresponding to two distinct resonant frequencies, when e is small enough to produce the capacitive coupling between the two resonators. The shorter the distance e, the further apart the two reflection zeros created move, thus broadening the passband. However, if they are too far apart, they can cause the broadened passband to split into two distinct passbands through the reappearance of a sizeable reflection between the two zeros, this running counter to the effect sought. Consequently, the distance e must be small enough to increase the passband but also sizeable enough not to generate undesired reflection inside the passband.

In a conventional manner, for good operation of the resonators of a filtering device with coupled resonators, each conducting strip must be of length $\lambda/4$, where $\lambda$ is the apparent wavelength, for a substrate considered, corresponding to the upper operating frequency of the filtering device. Thus, if the conducting strips were disposed linearly straight in line with the input and output ports of the filtering device 50, the assembly would reach a length of around $\lambda/2$: in practice, for a frequency of 3 GHz, a length close to 3 cm would be obtained for example.

But in fact, the conducting strips LE1, LE2, LS1 and LS2 are advantageously folded back on themselves so as to form additional capacitive and magnetic couplings locally between their two ends. The size of the filtering device 50 is thus reduced for at least two reasons: geometrically the fold-backs cause a reduction in the size of the assembly, but furthermore, by virtue of the capacitive and magnetic couplings, the size of each conducting strip can further be reduced while ensuring good operation of the resonators. This capacitive and magnetic coupling moreover generates a feedback between the input and the output of each conducting strip, so as to create one or more additional transmission zeros at frequencies greater than the upper limit of the passband of the filtering device 50. The high-band rejection is thus improved.

In the embodiment illustrated in FIG. 4, the four conducting strips are of annular general form, their ends being folded back inside this annular general form over a predetermined portion of their length.

For good operation of the filtering device 50, the fold-back of the ends of each conducting strip is situated on a portion of this conducting strip disposed opposite the other conducting strip of the same resonator. Thus, the fold-backs of ends of the conducting strips LE1 and LE2 are disposed opposite one another on either side of the symmetry plane P' and in proximity to the latter.

More precisely, the conducting strip LE1 is of rectangular general form and consists of rectilinear conducting segments. A first segment LE1, comprising a first free end of the conducting strip LE1 extends toward the interior of the rectangle formed by the conducting strip over a length L in a direction orthogonal to the virtual ground plane P'. A second segment $LE1_2$, joined to this first segment at right angles, constitutes a part of the side of the rectangle parallel to the virtual ground plane P' and close to the latter. A third segment $LE1_3$, joined to this second segment at right angles, constitutes the side of the rectangle orthogonal to the virtual ground plane P' and linked to the conductor E"1 of the input port. A fourth segment $LE1_4$, joined to this third segment at right angles, constitutes the side of the rectangle parallel to the virtual ground plane P' and close to an outer edge of the substrate. A fifth segment $LE1_5$, joined to this fourth segment at right angles, constitutes the side of the rectangle orthogonal to the virtual ground plane P' and opposite from the side $LE1_3$. A sixth segment $LE1_6$, joined to this fifth segment at right angles, constitutes like the second segment $LE1_2$ a part of the side of the rectangle parallel to the virtual ground plane P' and close to the latter. Finally, a seventh segment $LE1_7$ comprising the second free end of the conducting strip LE1, joined to the sixth segment at right angles, extends toward the interior of the rectangle over the length L in a direction orthogonal to the virtual ground plane P', that is to say parallel to the segment LE1, and opposite the latter over the whole of the length L of fold-back.

The segments LE1, and $LE1_7$ are a constant distance $e_s$ apart over the whole of their length thereby ensuring their capacitive coupling.

The conducting strip LE1 can also be viewed as consisting of a folded main conducting strip joined at one of its ends to the conductor E"1, this main conducting strip comprising the segments $LE1_1$, $LE1_2$ and that part of the segment $LE1_3$ situated between the segment $LE1_2$ and the conductor E"1, and of a "stub"-type branch-off folded back on the main conducting strip, this "stub"-type branch-off comprising the other part of the segment $LE1_3$, and the segments $LE1_4$ to $LE1_7$. The "stub"-type branch-off is then considered to be placed at the junction between the main conducting strip and the conductor E"1. It ought theoretically to exhibit a total length of λ/4, but the capacitive and magnetic couplings caused by the folding back of the conducting strip LE1 on itself make it possible to reduce this length, in particular by 10 to 20% over the "stub" branch-off.

It is moreover interesting to note that a sufficiently reduced size of the segment $LE1_4$ makes it possible for the segments $LE1_3$ and $LE1_5$, and also the segments $LE1_3$ and $LE1_1$, or the segments $LE1_5$ and $LE1_7$, to be brought closer together so as to multiply the number of capacitive and magnetic couplings caused by the folding back of the conducting strip LE1 on itself. These multiple couplings improve the operation of the filtering device 50.

The length L of coupling between the two folded-back ends, i.e. the two segments LE1, and $LE1_7$, mainly influences the passband of the filtering device 50, but also has a secondary effect on the high-band rejection. The more it increases, the more the passband is reduced but the more the high-band rejection is improved.

The distance $e_s$ between the two folded-back ends mainly influences the high-band rejection of the filtering device 50: the more it is reduced, the more the high-band rejection is improved. It will be noted however that this distance may not be less than a limit imposed by the precision of the etching of the conducting strip LE1 on the substrate.

The conducting strip LE2 consists, like the conducting strip LE1, of seven conducting segments disposed on the plane face 56 of the substrate in a symmetric manner to the seven segments $LE1_1$ to $LE1_7$ with respect to the virtual ground plane P'. The two conducting strips LE1 and LE2 are a constant distance $e_1$ apart, corresponding to the distance which separates the segments $LE1_2$ and $LE1_6$, on the one hand, from the segments, on the other hand.

This distance $e_1$ mainly influences the impedance of the first resonator 52, that is to say the input impedance of the filtering device 50, but also has a secondary effect on the passband of the filtering device 50. The more it increases, the more the impedance increases and in a less marked manner, the more the passband is reduced. The two resonators 52 and 54 being symmetric with respect to an axis normal to the virtual ground plane P' situated on the plane face 56, the conducting strips LS1 and LS2 each consist, like the conducting strips LE1 and LE2, of seven conducting segments, printed on the plane face 56 of the substrate in a symmetric manner to the segments of the conducting strips LE1 and LE2 with respect to this axis. Also by symmetry, the two conducting strips LS1 and LS2 are a constant distance $e_2$ apart, equal to $e_1$, corresponding to the distance which separates the segments $LS1_2$ and $LS1_6$, on the one hand, from the segments $LS2_2$ and $LS2_6$, on the other hand.

This distance $e_2$ also influences mainly the impedance of the second resonator 54, that is to say the output impedance of the filtering device 50, but also has a secondary effect on the passband of the filtering device 50. The more it increases, the more the impedance increases and in a less marked manner, the more the passband is reduced.

The distance e separating the two resonators 52 and 54 corresponds to the distance which separates the bottom segments of resonator 52 from the top segments of resonator 54. The capacitive coupling between the two resonators 52 and 54 is therefore established over the whole of the length of the bottom segments of resonator 52 and the top segments of resonator 54.

A topology such as that illustrated in FIG. 4, where the length of the rectangle formed by any one of the conducting strips is about twice as large as its width and where the fold-back of length L is made over half the length of the rectangle inside the latter, yields dimensions of around λ/30 by λ/60 for the rectangle formed by each conducting strip, i.e. dimensions of around λ/15 by λ/30 for the filtering device 50. These dimensions make it possible to achieve markedly better compactness than those of the existing devices.

Figure 5:
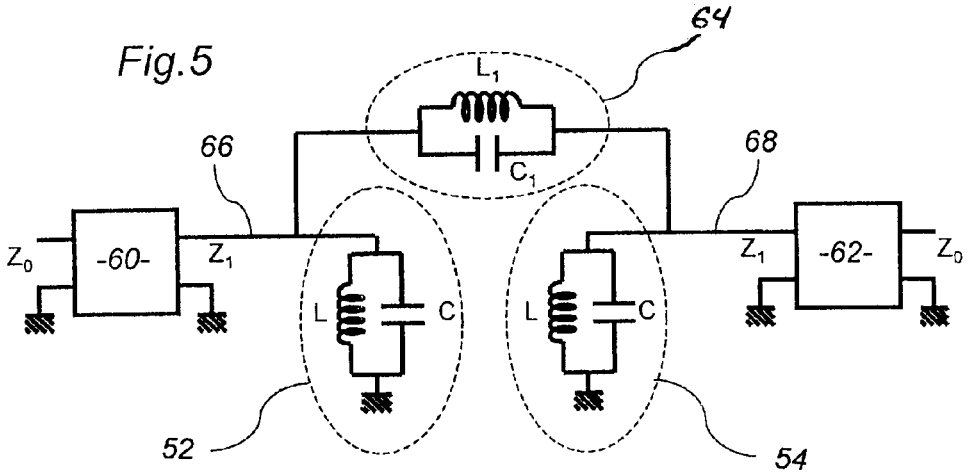
FIG. 5 represents an equivalent electrical diagram of the filtering device of FIG. 4.

FIG. 5 schematically presents an equivalent electrical circuit of the filtering device 50 (FIG. 4) previously described.

In this circuit, a first inverter 60 represents an impedance jump, from $Z_0$ to $Z_1$, at the input of the filtering device 50 (FIG. 4). The impedance $Z_o$ is determined by the parameters s and w of the conductors E"1 and E"2 of the input port, while the impedance $Z_1$ is determined in particular by the distance $e_1$ between the conducting strips LE1 and LE2 (FIG. 4).

A second inverter 62 represents the corresponding impedance jump, from $Z_1$ to $Z_0$, at the output of the filtering device 50.

The first and second coupled resonators 52 and 54 (FIG. 4) are each represented by an LC circuit with capacitance C and inductance L in parallel. These two LC circuits are linked, on the one hand, respectively to the first and second inverters 60 and 62 and, on the other hand, to the ground.

Finally, the folding back of the conducting strips LE1, LE2, LS1 and LS2 (FIG. 4) creates additional couplings, inside each resonator but also between the resonators, that can be represented by an LC feedback circuit 64, with capacitance C1 and inductance L1 in parallel, linked, on the one hand, to the junction 66 between the first resonator 52 and the first inverter 60 and, on the other hand, to the junction 68 between the second resonator 54 and the second inverter 52. This LC feedback circuit 54 improves the high-band rejection of the filtering device 50 by adding one or more transmission zeros in the high frequencies.

Figure 6:
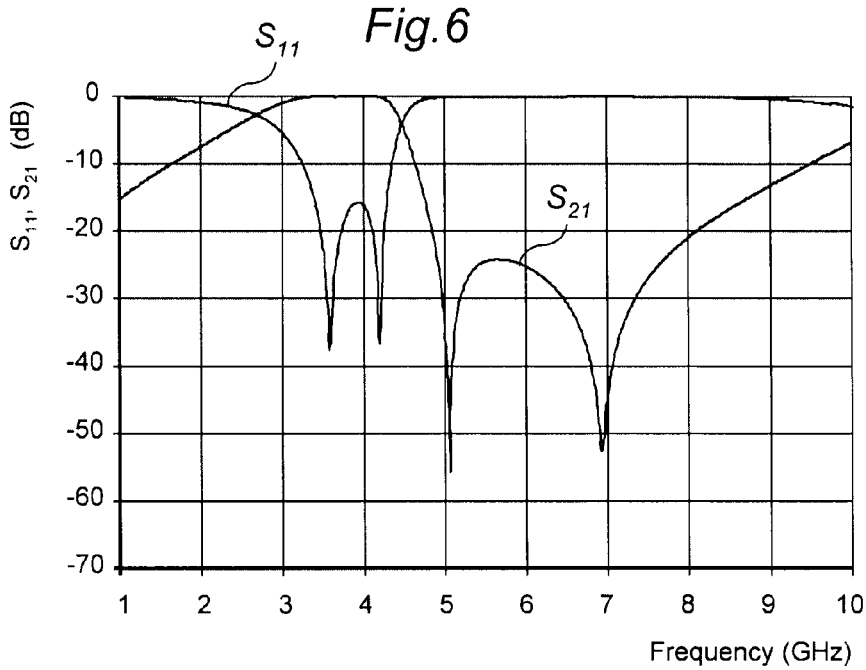
FIG. 6 illustrates the characteristic of a frequency response in terms of transmission and reflection of the filtering device of FIG. 4, FIG. 7 schematically represents the general structure of a second exemplary filtering device for producing a higher-order filter according to the invention, FIG. 8 schematically represents the general structure of a third exemplary filtering device for producing a higher-order filter according to the invention, FIG. 9 schematically represents the general structure of a filtering and impedance matching assembly with two filters such as that of FIG. 8, according to an embodiment of the invention, FIG. 10 schematically represents the general structure of a higher-order filter according to a first embodiment of the invention, FIG. 11 schematically represents the general structure of a higher-order filter according to a second embodiment of the invention.

The graph illustrated in FIG. 6 {dB vs. frequency (GHz)} represents the characteristic of a frequency response in terms of transmission and reflection of the filtering device previously described.

The reflection coefficient $S_{11}$ of this frequency response shows a −10 dB passband (generally accepted definition of the passband in reflection) lying between about 3.2 and 4.4 GHz. As indicated previously, the passband is broadened by the presence of two distinct reflection zeros inside this passband, these two zeros being due to the presence of the two coupled resonators a distance e apart in the filtering device 50. However, it is clearly seen in FIG. 6 that if they are too far apart, the portion of curve $S_{11}$ situated between these two reflection zeros may rise back above −10 dB, thereby causing the broadened passband to split into two distinct passbands. Consequently, the distance e must not be too small so as not to cause reflection of greater than −10 dB in the broadened passband.

The transmission coefficient $S_{21}$ of the frequency response shows a −3 dB passband (generally accepted definition of the passband in transmission) lying between about 2.7 and 4.5 GHz, as well as two transmission zeros at about 5.1 and 6.9 GHz.

One of these two out-of-band transmission zeros is due to the coupling between the two resonators of the filtering device 50 over the whole of the length of their portions $LE1_5$, $LE2_5$ on the one hand and $LS1_5$, $LS2_5$ on the other hand. The other of these two transmission zeros is due to the additional intra-resonator couplings created by the folding back of the conducting strips on themselves. These two transmission zeros give rise to a large high-band rejection of the filter and an asymmetry of the frequency response on account of the medium low-band rejection. But this asymmetry can turn out to be advantageous, in particular for an application relating to the direct integration of the filtering device 50 into a differential antenna. Indeed, such antennas generally exhibit large resonances at low frequency and are consequently equivalent to high-pass filters, thereby compensating for the asymmetry of the filtering device 50, improving its low-band rejection.

Figure 7:
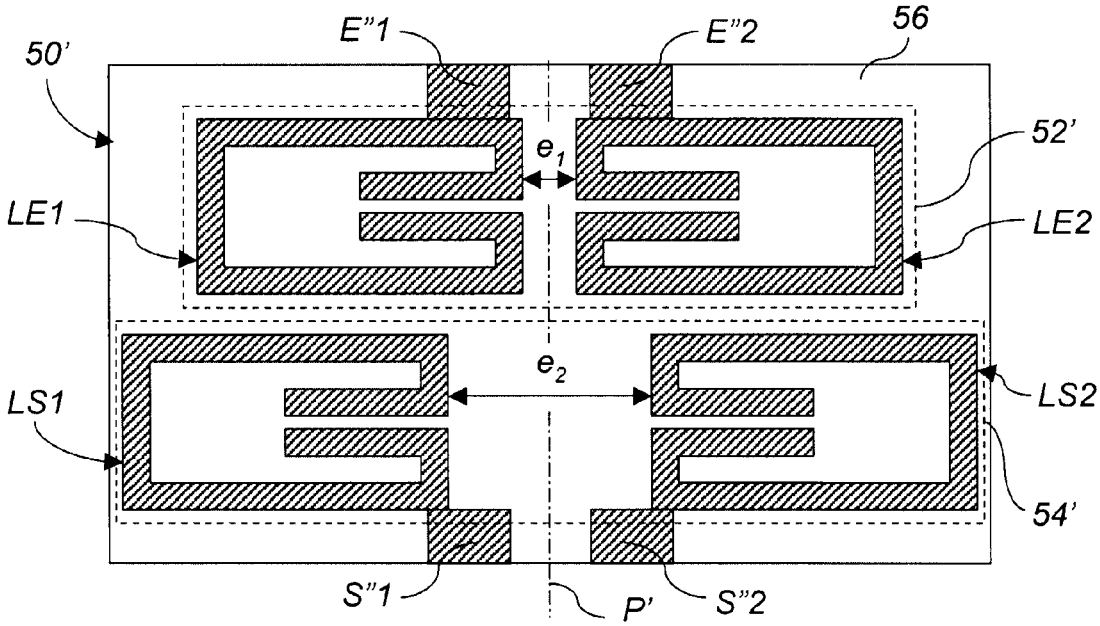

A second exemplary differential filtering device with improved compactness is represented schematically in FIG. 7. This device 50' comprises a pair of resonators 52' and 54', coupled together by capacitive coupling and disposed on one and the same plane face 56 of a dielectric substrate. These two resonators are similar to those, 52 and 54, of the device of FIG. 4. Elements E"1, E"2, S"1, and S"2 denote ends of the circuit.

On the other hand, in this second example, the two resonators 52' and 54' are not symmetric with respect to an axis normal to the plane P' situated on the plane face 56. Indeed, the distance $e_1$ separating the two conducting strips LE1 and LE2 of the first resonator 52' is different from the distance $e_2$ separating the two conducting strips LS1 and LS2 of the second resonator 52'. In the example illustrated, the distance $e_2$ is greater than the distance $e_1$.

However, the capacitive coupling between the two resonators 52' and 54' is not broken for all that. Indeed, on account of the folding back of the conducting strips on themselves, the latter remain opposite one another over at least a portion of their length, more precisely over at least a portion of the lengths $LE1_5$ and $LS1_5$, on the one hand, and of the lengths $LE2_5$ and $LS2_5$, on the other hand. In comparison with the existing one, it would not for example be possible to design such a difference between the distances $e_1$ and $e_2$ in the filtering device described with reference to FIG. 12 of the aforementioned document "Broadband and compact coupled coplanar stripline filters with impedance steps", because in this document, it is the free ends of the conducting strips which are disposed opposite one another so that a shift, even slight, between them would break the capacitive coupling between the two resonators.

Since these distances $e_1$ and $e_2$ make it possible to adjust respectively the input and output impedances of the filtering device 50', it is thus possible to design a bandpass filtering device which furthermore fulfills a function of impedance matching between the circuits to which it is intended to be connected. In the example illustrated in FIG. 7, the distance $e_1$ thus causes an input impedance $Z_1$ that is less than the output impedance $Z_2$ caused by the distance $e_2$.

This second example allows the direct integration of a filtering device according to the invention with differential antennas and differential active circuits of different impedances. It will be noted however that direct integration such as this with a single filtering device operates all the better the smaller the difference between the impedances $Z_1$ and $Z_2$.

Alternatively, an assembly of several filtering devices according to the second example of the invention added in series can be used so as to facilitate the impedance matching between circuits with very different impedances.

Figure 8:
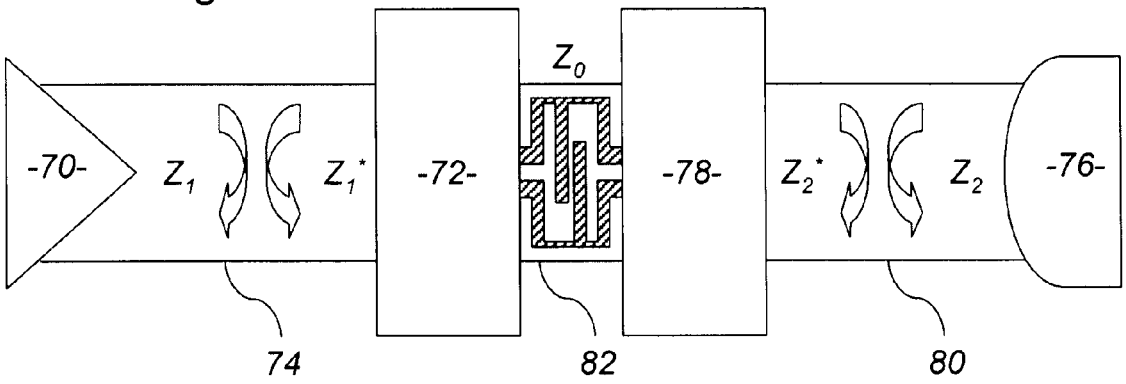

Such an assembly with two filtering devices is for example represented schematically in FIG. 8.

In this assembly, an amplifier 70 is joined to the input of a first filtering device 72, via the input port 74 of this first filtering device. The impedance of the amplifier 70 having a value $Z_1$, the first filtering device 72 is designed, by adjustment of the distance between the folded-back conducting strips of its first resonator, to exhibit an input impedance of conjugate value $Z_1$* thus ensuring maximum transfer of power between the first filtering device 72 and the amplifier 70.

An antenna 76 is joined to the output of a second filtering device 78, via the output port 80 of this second filtering device. The impedance of the antenna 76 having a value $Z_2$, the second filtering device 78 is designed, by adjustment of the distance between the folded-back conducting strips of its second resonator, to exhibit an output impedance of conjugate value $Z_2$* thus ensuring maximum transfer of power between the second filtering device 78 and the antenna 76.

Finally, the two filtering devices 72 and 78 are advantageously joined together via a quarter-wave line 82 according to the invention fulfilling an inverter function, the output of the first filtering device 72 and the input of the second filtering device 78 being designed, by adjustment of the distance between the folded-back conducting strips of the second resonator of the first filtering device 72 and of the distance between the folded-back conducting strips of the first resonator of the second filtering device 78, to exhibit one and the same impedance $Z_o$. This same impedance $Z_o$ ensures the matching of impedances and can be chosen so as to ensure the best possible rejection.

Thus, the matching of the possibly very different impedances $Z_1$ and $Z_2$ is done by passing via an intermediate impedance $Z_0$ by virtue of the assembly comprising the two asymmetric filtering devices 72 and 78 and the quarter-wave line 82.

The presence of the quarter-wave line 82 between the two filtering devices 72 and 78 furthermore makes it possible to globally improve the performance of the higher-order filter thus constructed, in terms of passband.

Figure 9:
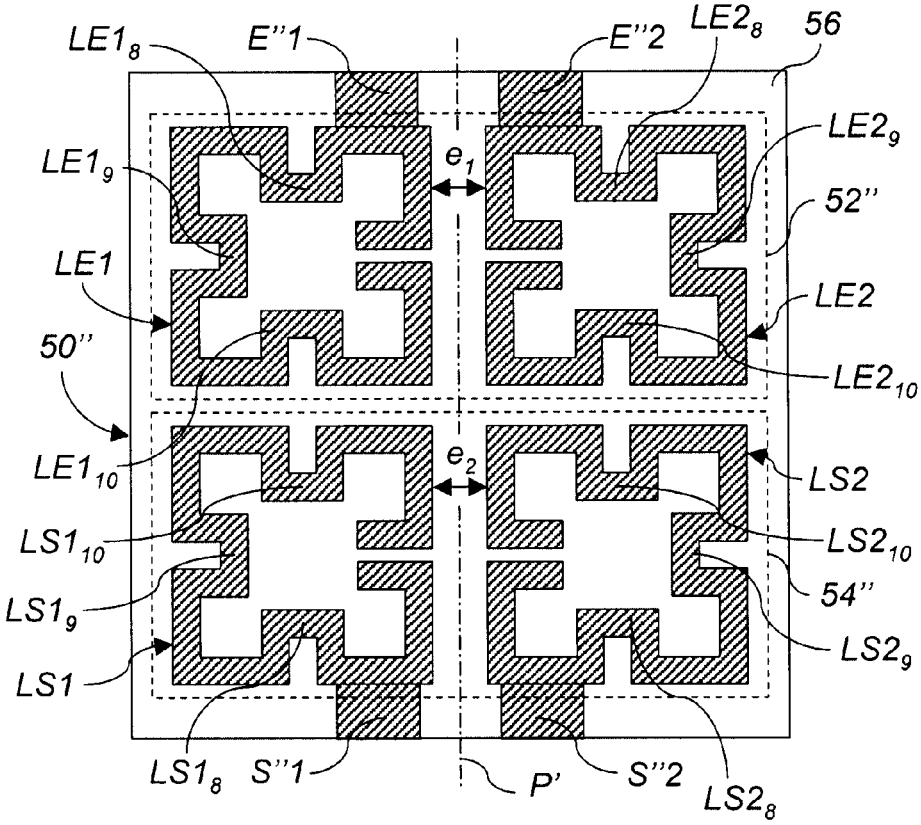

A third exemplary differential filtering device with improved compactness is represented schematically in FIG. 9. This filtering device 50" comprises a pair of resonators 52" and 54", coupled together by capacitive coupling and disposed on one and the same plane face 56 of a dielectric substrate. Elements E"1, E"2, S"1, and S"2 in FIG. 9 denote ends of the circuit.

In this third example, the two resonators 52" and 54" are symmetric with respect to an axis normal to the plane P' situated on the plane face 56. Consequently, the distance $e_1$ separating the two conducting strips LE1 and LE2 of the first resonator 52" is equal to the distance $e_2$ separating the two conducting strips LS1 and LS2 of the second resonator 54". As a variant, these two distances could be different, as in the second example, so that the filtering device furthermore fulfills an impedance matching function.

On the other hand, this third example is distinguished from the first and second examples by the general form of the folded-back conducting strips.

Indeed, in this example, the four conducting strips are of annular general form, their ends being folded back inside this annular general form over a predetermined portion of their length, but they are more precisely of square general form. Furthermore, each of them comprises additional fold-backs over at least a part of the sides of the square general form.

For example, the conducting strip LE1 comprises three additional fold-backs $LE1_8$, $LE1_9$ and $LE1_{10}$ in the three sides of the square general form not comprising the fold-back of its two ends. To improve the compactness of the assembly, the three additional fold-backs are directed toward the interior of the square general form. They are for example notch-shaped. By symmetry, the conducting strips LE2, LS1 and LS2 comprise the same additional fold-backs, referenced $LE2_8$, $LE2_9$ and $LE2_{10}$ for the conducting strip LE2; $LS1_8$, $LS1_9$ and $LS1_{10}$ for the conducting strip LS1; $LS2_8$, $LS2_9$ and $LS2_{10}$ for the conducting strip LS2.

In this example, the square general form of each conducting strip LE1, LE2, LS1 and LS2 implies a square general form of the filtering device 50". The compactness of the latter is therefore optimal.

Moreover, the additional fold-backs create additional capacitive and magnetic couplings that may further improve the performance of the filtering device 50".

As indicated previously, the length L of the fold-back of the two ends of each conducting strip inside its square general form can be adjusted so as to adjust the passband of the filtering device 50".

In this square topology, dimensions of the filtering device 50" of around $\lambda/20$ per side are for example obtained.

It will be noted that a filtering device with improved compactness is not limited to the examples described above. Other geometric forms are conceivable for such a filtering device, so long as they provide for a folding back of each conducting strip of each resonator on itself so as to form a capacitive coupling between its two ends.

This filtering device with improved compactness is particularly suitable for the design, with a bi-strip line according to the invention, of a higher-order filter of reduced size.

Figure 10:
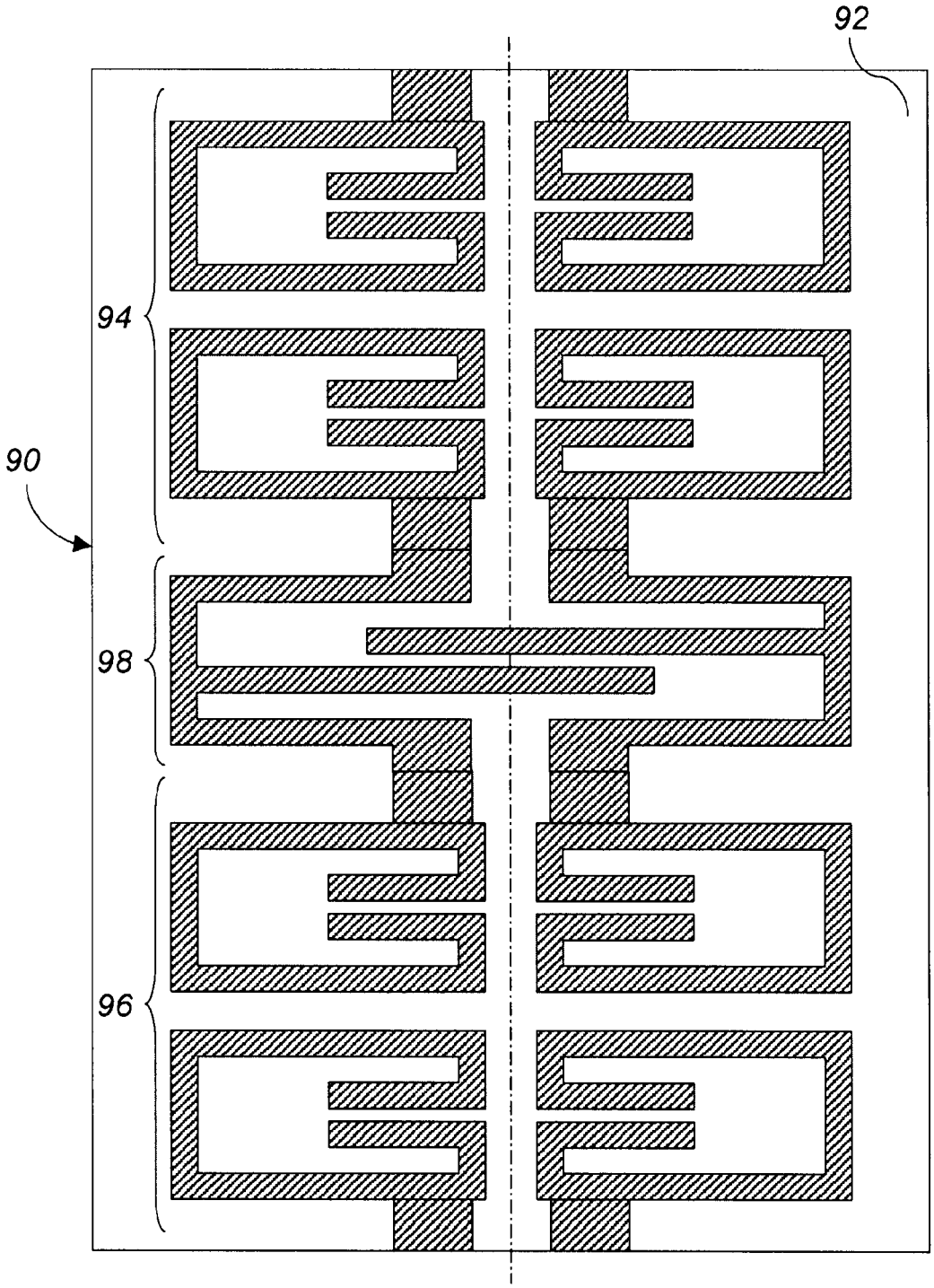

For example, as illustrated in FIG. 10, a higher-order differential filter 90 etched on a substrate 92 comprises two differential filtering devices with coplanar coupled resonators 94 and 96 in accordance with the first example illustrated in FIG. 4. It furthermore comprises a differential bi-strip line 98 in accordance with that represented in FIG. 3 joined, via one of its two bi-strip ports, to one of the two differential filtering devices and, via its other bi-strip port, to the other of the two differential filtering devices.

Figure 11:
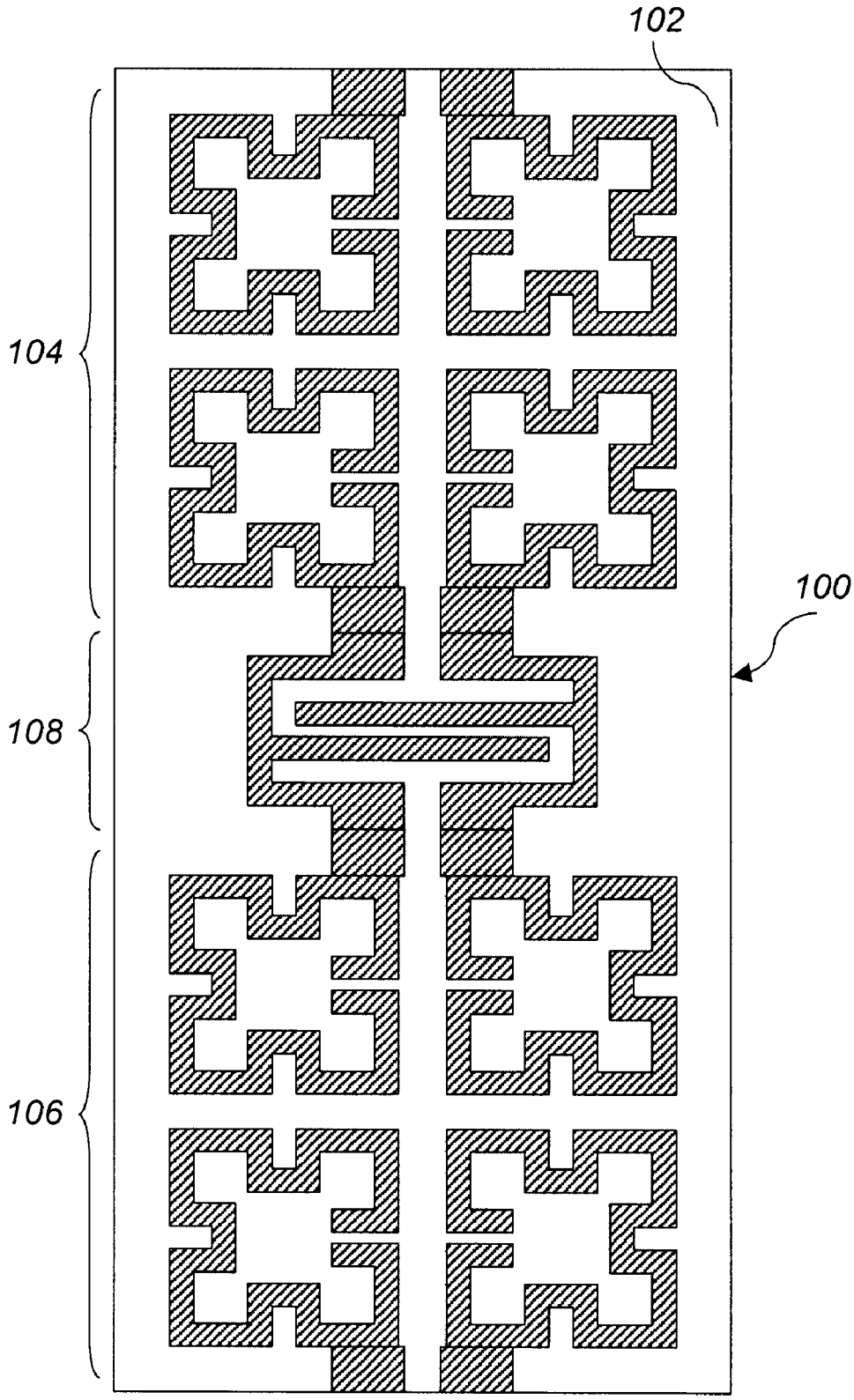

For example also, as illustrated in FIG. 11, a higher-order differential filter 100 etched on a substrate 102 comprises two differential filtering devices with coplanar coupled resonators 104 and 106 in accordance with the third example illustrated in FIG. 9. It furthermore comprises a differential bi-strip line 108 in accordance with that represented in FIG. 3 joined, via one of its two bi-strip ports, to one of the two differential filtering devices and, via its other bi-strip port, to the other of the two differential filtering devices.

Specifically, this higher-order filter is for example dimensioned so as to operate in a high frequency band allocated to Ultra Wide Band communications, according to the European UWB standard, or indeed between 6 and 9 GHz. The substrate 102 is for example a substrate with high permittivity ($\in r=10$). The dimensions of this higher-order filter 100 with improved compactness are then 6 mm long by 3.5 mm wide.

The graph illustrated in FIG. 12 {with dB vs. F(Ghz)} represents the characteristic of a frequency response in terms of transmission and reflection of the higher-order filter illustrated in FIG. 11.

The reflection coefficient $S_{11}$ of this frequency response shows a −10 dB passband (generally accepted definition of the passband in reflection) lying between about 6 and 9 GHz and exhibits four reflection zeros in the passband.

The transmission coefficient $S_{21}$ of this frequency response shows a −3 dB passband (generally accepted definition of the passband in transmission) also lying between about 6 and 9 GHz, as well as a transmission zero at around 9.8 GHz.

This transmission zero gives rise to a large high-band rejection of the filter and an asymmetry of the frequency response on account of the medium low-band rejection. Rejections of the order of 50 dB in the high band and 30 dB in the low band are obtained. But, as indicated previously, this asymmetry can turn out to be advantageous, in particular for an application of direct integration of this filter 100 into a differential antenna.

Figure 14:
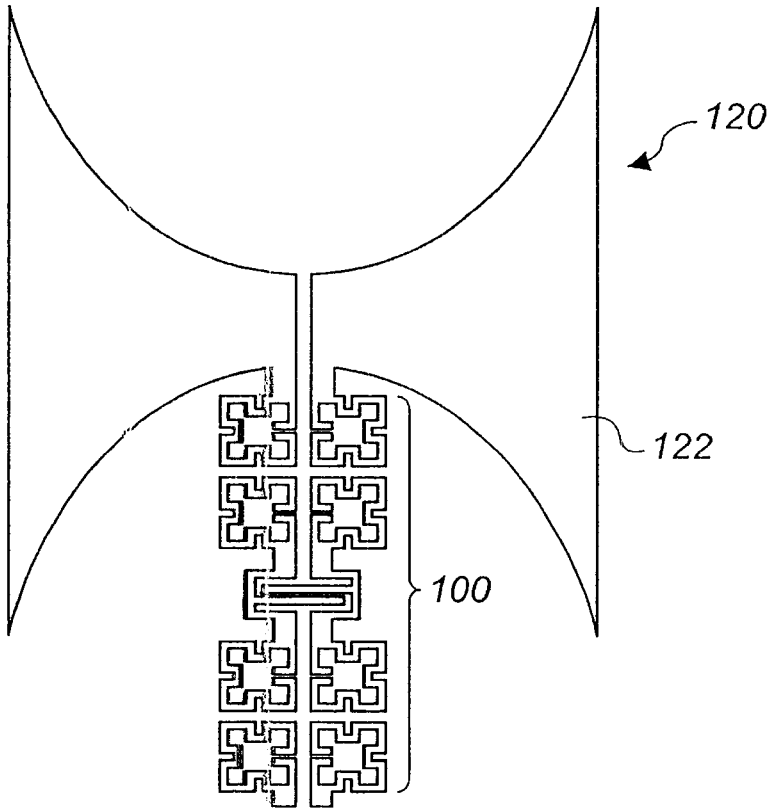
Figure 15:
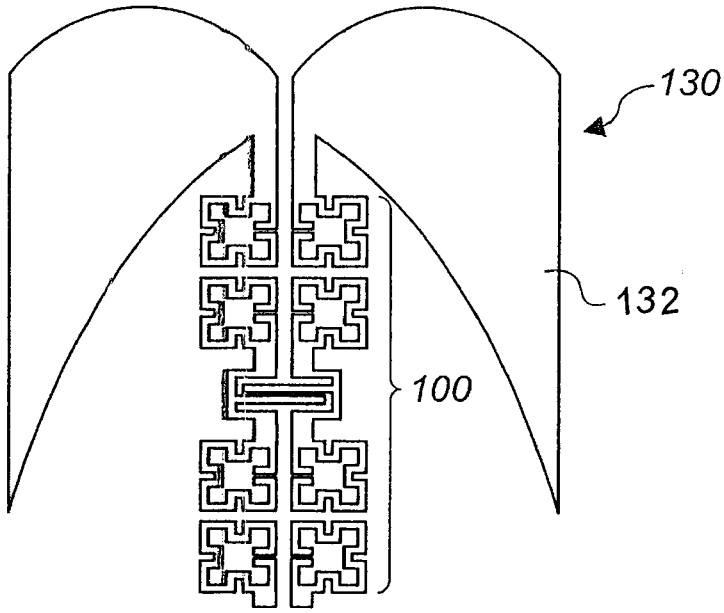

FIGS. 13 to 15 schematically illustrate three examples of differential filtering dipole antennas each advantageously integrating a higher-order differential filter with improved compactness such as that illustrated in FIG. 11.

The filtering dipole antenna 110 represented in FIG. 13 comprises on the one hand a radiating electric dipole 112 and on the other hand a higher-order differential filter 100 such as that described with reference to FIG. 11. The electric dipole 112 is more precisely a coplanar thick dipole etched on a substrate and whose radiating structure is of elliptical form. This type of dipole has a very wide passband.

The relative passband defined by the relation $\Delta f/f_0$, where $\Delta f$ is the width of the passband and $f_o$ the central operating frequency of the antenna, can exceed 100%.

The two arms of the dipole 112 are connected directly to the two conductors of the output port of the filter 100. The two conductors of the input port of the filter 100 are for their part intended to be fed with differential signal.

The filtering dipole antenna 120 represented in FIG. 14 comprises on the one hand a radiating electric dipole 122 and on the other hand a higher-order differential filter 100 such as that described with reference to FIG. 11. The electric dipole 122 is more precisely a coplanar thick dipole etched on a substrate and whose radiating structure is of "butterfly" form. More precisely, the radiating structure of the dipole exhibits a fine part, in a central zone of the antenna comprising the connection to the filter 100, which broadens out toward the exterior of the antenna on both sides of the dipole. This type of radiating dipole has a medium passband. Its relative passband $\Delta f/f_0$ is of the order of 20%.

As previously, the two arms of the dipole 122 are connected directly to the two conductors of the output port of the filter 100. The two conductors of the input port of the filter 100 are for their part intended to be fed with differential signal.

Finally, the filtering dipole antenna 130 represented in FIG. 15 comprises on the one hand a radiating electric dipole 132 and on the other hand a higher-order differential filter 100 such as that described with reference to FIG. 11. The electric dipole 132 is more precisely a coplanar thick dipole etched on a substrate and whose radiating structure is of "butterfly" form. It differs however from the electric dipole 122 in particular in that the two wide ends of its radiating structure, oriented toward the exterior of the antenna, are devised so as to integrate into their exterior dimensions (i.e. larger length and larger width) the filter 100. This results in an additional gain in compactness of the filtering antenna 130 with respect to the filtering antenna 120.

Moreover, as previously, the two arms of the dipole 132 are connected directly to the two conductors of the output port of the filter 100. The two conductors of the input port of the filter 100 are for their part intended to be fed with differential signal.

For a constant number of filtering devices, a differential filtering dipole antenna according to the invention is smaller than a conventional corresponding antenna, in particular by virtue of the better compactness of the differential bi-strip line used. Alternatively, for a constant overall size, a differential filtering dipole antenna according to the invention is more efficacious because it can comprise a larger number of filtering devices making it possible to carry out a filtering of yet higher order, which is therefore more efficacious in terms of passband.

It is clearly apparent that a differential bi-strip delay line such as that described previously with reference to FIG. 3 can achieve much better compactness than that of the known differential bi-strip lines embodied using CPS technology, while preserving their characteristics.

Having regard to the frequency bands in which it can operate when it is associated with filtering devices embodied using CPS technology, it is particularly suited to the new radiocommunication protocols which require very wide passbands. Furthermore, its compactness makes it advantageous for miniature communicating objects.

The coplanar structure of this differential bi-strip delay line furthermore facilitates its embodiment using hybrid technology and its integration using monolithic technology with structures comprising discrete surface-mounted elements. In particular, it is simple to design it as an element of a higher-order filter integrated with a differential dipole antenna with broadband coplanar radiating structure, as has been illustrated by several examples, by chemical or mechanical etching on substrates of low or high permittivity according to the desired applications and performance.

A higher-order filter according to the invention can also find applications in the millimetric frequency band where its small size and its high performance allow it to be integrated using monolithic technology with antennas and active circuits.

Finally, it will be noted that applications other than those presented above are also conceivable for a bi-strip line according to the invention. In particular, a bi-strip line according to the invention can be used as a phase shifter, for example in an antenna array feed application where several different antennas having different phase shifts are fed by one and the same source. In this case, the antennas can be linked together by bi-strip lines according to the invention.

The invention claimed is:

1. A coplanar differential bi-strip delay line, comprising:

two meandering conducting strips disposed on one and a same face of a dielectric substrate and each comprising a first and a second end, the two first ends of the two meandering conducting strips forming two distinct conductors of a first bi-strip port for connection to a first external differential device, the two second ends of the two meandering conducting strips forming two distinct conductors of a second bi-strip port for connection to a second external differential device, wherein the bi-strip delay line is in a form of a printed circuit so as to exhibit structural discontinuities which generate at least one impedance jump and at least one capacitive coupling with interdigitated capacitance between the two meandering conducting strips so as to reproduce a predetermined phase shift, and the interdigitated capacitance is formed by at least one pair of overlapping conducting fingers, different from the two meandering conducting strips, joined respectively by one end of the overlapping conducting fingers, respectively, to the two conducting strips.

2. The coplanar differential bi-strip delay line as claimed in claim 1, wherein at least one of the structural discontinuities comprises a variation of a distance between the two meandering conducting strips for producing an impedance jump.

3. The coplanar differential bi-strip delay line as claimed in claim 2, wherein the at least one of the structural discontinuities includes a first discontinuity and a second discontinuity, and the first discontinuity of increase in the distance between the two meandering conducting strips and the second discontinuity of reduction in the distance between the two meandering conducting strips form a zone in which the bi-strip line exhibits a separation between the two meandering conducting strips which is greater than a separation between the two meandering conductors of each of the first and second bi-strip ports.

4. The coplanar differential bi-strip delay line as claimed in claim 3, wherein the interdigitated capacitance is formed in the zone where the bi-strip line exhibits a larger separation between the two meandering conducting strips, the pair of overlapping conducting fingers extending laterally toward an interior of the zone from the two meandering conducting strips, respectively.

5. The coplanar differential bi-strip delay line as claimed in any one of claims 1 to 4, wherein the structural discontinuities generate the at least one impedance jump and the at least one capacitive coupling between the two conducting strips so that the bi-strip delay line reproduces a quarter-wave phase shift.

6. A higher-order differential filter comprising:

two differential filtering devices with coplanar coupled resonators; and a coplanar differential bi-strip delay line as claimed in claim 1, the bi-strip line being joined, via the first bi-strip port, to one of the two filtering devices and, via the second bi-strip port, to the other of the two filtering devices.

7. The higher-order differential filter as claimed in claim 6, wherein each of the two differential filtering devices with coplanar coupled resonators comprises a pair of coupled resonators disposed on one and the same face of the dielectric substrate, each of the coupled resonators comprising two conducting strips positioned in a symmetric manner with respect to a plane perpendicular to the face on which the coupled resonators are disposed, the two conducting strips being joined respectively to two conductors of a differential bi-strip port of a corresponding differential filtering device, each of the two conducting strips of each resonator being furthermore folded back on itself so as to form a capacitive coupling between two ends of the two conducting strips.

8. A differential filtering dipole antenna comprising at least one higher-order differential filter as claimed in claim 6 or 7.

9. The differential filtering dipole antenna as claimed in claim 8, comprising a radiating structure devised so as to integrate said at least one higher-order differential filter in an exterior of the radiating structure.

* * * * *